US009176450B2

(12) United States Patent
Mimura

(10) Patent No.: US 9,176,450 B2
(45) Date of Patent: Nov. 3, 2015

(54) IMAGE FORMING APPARATUS THAT ERASES IMAGES DURING INTERRUPTION OF IMAGE FORMING

(71) Applicants: KABUSHIKI KAISHA TOSHIBA, Tokyo (JP); TOSHIBA TEC KABUSHIKI KAISHA, Tokyo (JP)

(72) Inventor: Toshifumi Mimura, Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/160,070

(22) Filed: Jan. 21, 2014

(65) Prior Publication Data

US 2015/0205242 A1 Jul. 23, 2015

(51) Int. Cl.
*G03G 15/20* (2006.01)
*G03G 15/00* (2006.01)

(52) U.S. Cl.
CPC ..... *G03G 15/55* (2013.01); *G03G 15/2039* (2013.01)

(58) Field of Classification Search
CPC .. G03G 15/55; G03G 15/205; G03G 15/2039
See application file for complete search history.

(56) References Cited

U.S. PATENT DOCUMENTS

| | | | | |
|---|---|---|---|---|
| 2009/0154970 | A1* | 6/2009 | Yoshida et al. | 399/341 |
| 2010/0196063 | A1* | 8/2010 | Iguchi et al. | 399/322 |
| 2011/0262197 | A1 | 10/2011 | Imamiya et al. | |
| 2013/0011149 | A1* | 1/2013 | Ogasawara et al. | 399/43 |
| 2014/0055546 | A1* | 2/2014 | Imamiya | 347/179 |

* cited by examiner

*Primary Examiner* — Francis Gray
(74) *Attorney, Agent, or Firm* — Patterson & Sheridan, LLP

(57) ABSTRACT

An image forming apparatus includes an image forming unit configured to form images that are to be transferred to first sheets, a fixing and erasing unit configured to fix the images onto the first sheets and erase images formed with a decolorizable material on second sheets, and a controller. The controller is configured to interrupt the image forming unit to stop forming images that are to be transferred to the first sheets, and control the fixing and erasing unit to carry out an erasing operation on the second sheets while the image forming unit is interrupted.

20 Claims, 4 Drawing Sheets

IMAGE FORMING APPARATUS THAT ERASES IMAGES DURING INTERRUPTION OF IMAGE FORMING

FIELD

Embodiments described herein relate generally to an image forming apparatus using a decolorizable recording material.

BACKGROUND

In the related art, an image forming apparatus forms an image on a sheet with a decolorizable material, and an erasing apparatus erases an image on a sheet formed with the decolorizable material, which is decolorized when the sheet is heated to a certain temperature. By using these apparatuses, sheets can be reused so that sheets used for image forming can be conserved. One type of the image forming apparatus has a fixing unit that can fix an image onto a sheet and erase an image formed on a sheet. Conventionally, this type of image forming apparatus carries out the fixing of the image and the erasing of the image separately.

DETAILED DESCRIPTION

Reference will now be made in detail to the present embodiment of the invention, an example of which is illustrated in the accompanying drawing.

In general, according to one embodiment, an image forming apparatus includes an image forming unit configured to form images that are to be transferred to first sheets, a fixing and erasing unit configured to fix the images onto the first sheets and erase images formed with a decolorizable material on second sheets, and a controller. The controller is configured to interrupt the image forming unit to stop forming images that are to be transferred to the first sheets, and control the fixing and erasing unit to carry out an erasing operation on the second sheets while the image forming unit is interrupted.

Hereinafter, the exemplary embodiments will be described in detail.

(First Embodiment)

Figure 1:
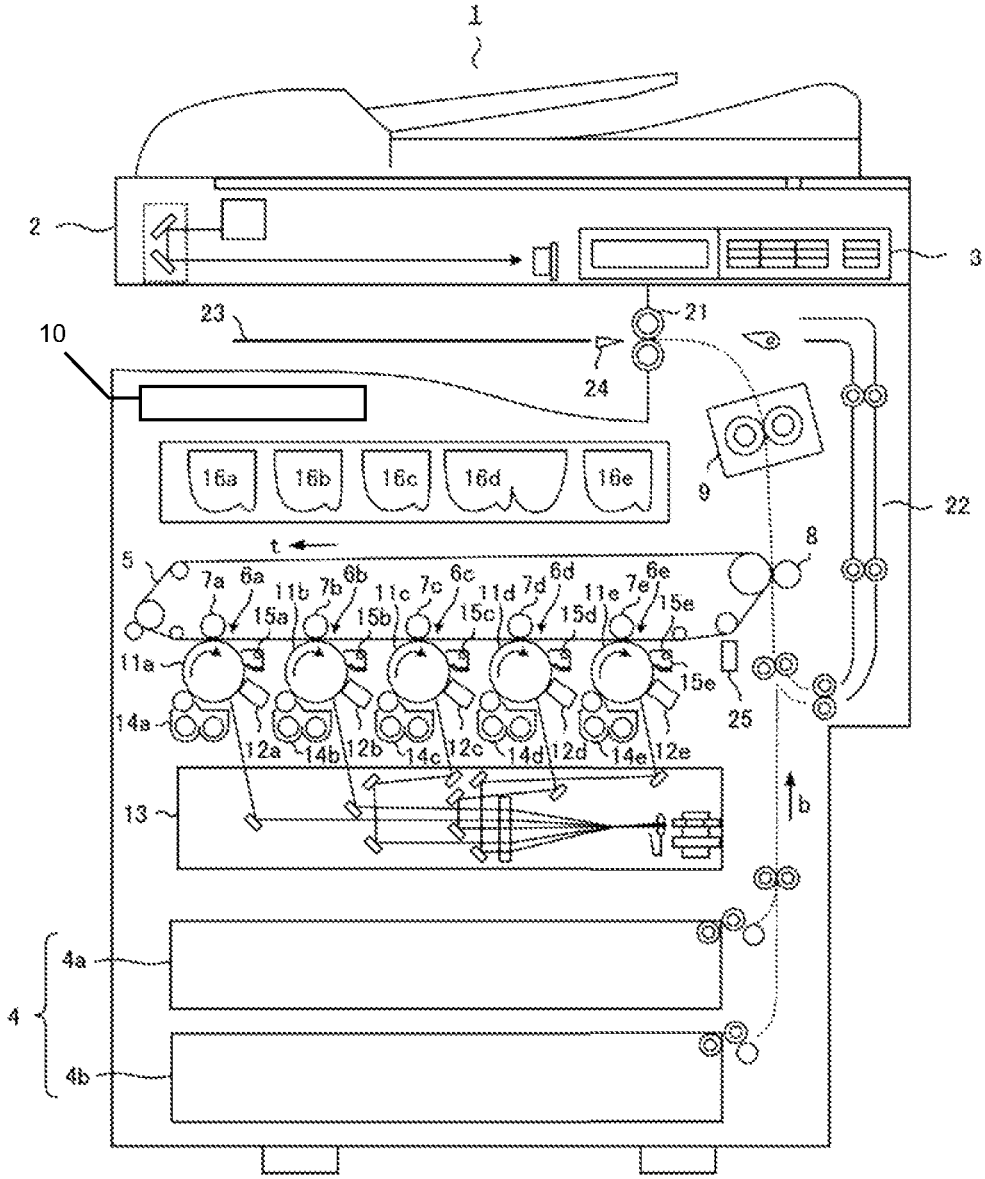
FIG. 1 is a schematic configuration diagram of an image forming apparatus according to a first embodiment.

FIG. 1 is a schematic configuration diagram of an image forming apparatus according to a first embodiment. A multi functional peripheral (MFP) 1 is an image forming apparatus that carries out a quintuplicate tandem process with five image forming units 6*a*, 6*b*, 6*c*, 6*d*, and 6*e*. The MFP 1 includes a scanner 2 which scans an original document and a control panel 3 as an operation unit, on an upper portion thereof. A paper feeding unit 4 is disposed at a lower portion of the MFP 1. The paper feeding unit 4 includes a non-used paper accommodation unit 4*a* which accommodates a sheet as a recording medium, and an erasable image sheet accommodation unit 4*b* which accommodates a sheet having an image printed with the decolorizable recording material which can be decolorized. An intermediate transfer belt 5 which can be moved in an arrow t direction shown in FIG. 1, and the five image forming units 6*a*, 6*b*, 6*c*, 6*d*, and 6*e*, which are disposed in a vicinity thereof, are provided between the scanner 2 and the paper feeding unit 4. Further, the MFP 1 includes a controller 10 configured to carry out operations of the MFP 1 to be described below.

The image forming units 6*a*, 6*b*, 6*c*, 6*d*, and 6*e* form an image with non-decolorizable yellow toner (hereinafter, may be referred to as "Y toner"), non-decolorizable magenta toner (hereinafter, may be referred to as "M toner"), non-decolorizable cyan toner (hereinafter, may be referred to as "C toner"), and non-decolorizable black toner (hereinafter, may be referred to as "BK toner") which are non-decolorizable recording materials not having a decolorizing function, and a decolorizable blue toner (hereinafter, may be referred to as "E toner"), which is a decolorizable recording material having a decolorizing function, respectively. Herein, the image forming units 6*a*, 6*b*, 6*c*, and 6*d* including the non-decolorizable toner are set as a first image forming unit and the image forming unit 6*e* including the decolorizable toner is set as a second image forming unit. In the present disclosure, the non-decolorizable recording materials and the decolorizable recording material are collectively called recording materials.

Transfer rollers 7*a*, 7*b*, 7*c*, 7*d*, and 7*e* as transfer units which transfer a toner image formed by the image forming units 6*a*, 6*b*, 6*c*, 6*d*, and 6*e* onto the intermediate transfer belt 5 are disposed so as to oppose the image forming units 6*a*, 6*b*, 6*c*, 6*d*, and 6*e* with the intermediate transfer belt 5 disposed therebetween. A secondary transfer roller 8 as a transfer unit which transfers a toner image formed by at least one of the image forming units 6*a*, 6*b*, 6*c*, 6*d*, and 6*e* on the intermediate transfer belt 5, onto a sheet fed from the paper feeding unit 4, is disposed downstream with respect to the image forming unit 6*e* along a moving direction of the intermediate transfer belt 5. A fixing and erasing unit 9 which functions as both a fixing unit which fixes a toner image to a sheet and a decolorizing unit which decolorizes an image from a sheet, is disposed downstream with respect to the secondary transfer roller 8, along a sheet conveying direction (an arrow b direction in FIG. 1) of a sheet fed from the paper feeding unit 4.

The configurations of the image forming units 6*a*, 6*b*, 6*c*, 6*d*, and 6*e* are common with each other except for the toners accommodated therein, and thus, the configurations of the image forming units 6*a*, 6*b*, 6*c*, 6*d*, and 6*e* will be described using the image forming unit 6*a* as an example.

The image forming unit 6*a* includes a photoreceptor drum 11*a* as an image holding member. A charger 12*a* which charges the photoreceptor drum 11*a*, an exposure device 13 which emits a scanning line of a laser beam to the charged photoreceptor drum 11*a* according to image information, and a developer 14*a* which accommodates the non-decolorizable Y toner and develops an electrostatic latent image formed by the exposure device 13 are disposed in the vicinity of the photoreceptor drum 11*a*. In addition, the image forming unit 6*a* includes a cleaning device 15*a* which removes toner remaining on the photoreceptor drum 11*a* after the toner image on the photoreceptor drum 11*a* is transferred by the transfer roller 7*a*.

The image forming units 6*b*, 6*c*, 6*d*, and 6*e* include photoreceptor drums 11*b*, 11*c*, 11*d*, and 11*e*, chargers 12*b*, 12*c*, 12*d*, and 12*e*, the exposure device 13, developers 14*b*, 14*c*, 14*d*, and 14*e*, and cleaning devices 15*b*, 15*c*, 15*d*, and 15*e*, respectively, in the same manner. A toner accommodated in the developer 14*b* is the non-decolorizable M toner, a toner accommodated in the developer 14*c* is the non-decolorizable C toner, a toner accommodated in the developer 14*d* is the non-decolorizable BK toner, and a toner accommodated in the developer 14*e* is the decolorizable E toner.

Density of toner stored in each of the developers 14*a*, 14*b*, 14*c*, 14*d*, and 14*e* is detected, and new toner is supplied from cartridges 16*a*, 16*b*, 16*c*, 16*d*, and 16*e* to the developers 14*a*, 14*b*, 14*c*, 14*d*, and 14*e* respectively according to the detected density of the toner.

The image forming units 6*a*, 6*b*, 6*c*, 6*d*, and 6*e* can be switched according to a format of printing (hereinafter, also referred to as "recording"), that is, printing with the decolorizable recording material having a decolorizing function or the non-decolorizable recording material not having a decoloring function. When the printing is carried out with the decolorizable recording material, the image forming unit 6*e* approaches the intermediate transfer belt 5 and the image forming units 6*a*, 6*b*, 6*c*, and 6*d* move apart from the intermediate transfer belt 5, in order to prevent color mixing with the non-decolorizable recording materials. When the printing is carried out with the decolorizable recording material, a fixation temperature of the fixing and erasing unit 9 is controlled to be equal to or higher than a fixation temperature of the decolorizable recording material and lower than a decolorizing temperature.

On the other hand, when the printing is carried out with the non-decolorizable recording material, the image forming units 6*a*, 6*b*, 6*c*, and 6*d* approaches the intermediate transfer belt 5. In addition, a temperature of the fixing and erasing unit 9 is controlled to be equal to or higher than a fixation temperature of the non-decolorizable recording material.

A flapper (branch member) is provided downstream with respect to the fixing and erasing unit 9 and guides a sheet in a direction of a paper discharge roller 21 or a direction of a re-transportation unit 22. A sheet introduced to the paper discharge roller 21 is discharged to a paper discharge unit (paper tray) 23. In addition, a sheet introduced to the re-transportation unit 22 is conveyed in a direction of the secondary transfer roller 8.

An erasing operation for the sheet having an image formed with the decolorizable recording material is performed during an interruption operation which is performed during the printing with the non-decolorizable recording material. Herein, the interruption operation is an operation which is performed by stopping the printing operation for the sheet for a predetermined time period. More specifically, the interruption operation can include, for example, image quality maintaining operation, positioning operation, toner forcible supply operation (recording material forcible supply), development of printing data having a relatively larger capacity, and the like. A sheet having an erasable image which is accommodated in the erasable image sheet accommodation unit 4*b* is transported to the fixing and erasing unit 9 in the interruption operation. In this case, the temperature of the fixing and erasing unit 9 is controlled to be equal to or higher than the decolorizing temperature of the decolorizable recording material which is printed on the sheet. The sheet on which image is erased by passing the fixing and erasing unit 9 is guided to a lower portion of the paper discharge unit 23 by the flapper 24 and is separated from the sheet discharged after the printing operation.

In addition, since FIG. 1 is a color MFP 1, the image forming units 6*a*, 6*b*, and 6*c* using the different non-decolorizable recording materials are included. However an image forming apparatus which has only the image forming units 6*d* and 6*e* and uses only the non-decolorizable BK toner and the decolorizable E toner may be used.

The non-decolorizable toners, which are the recording materials of the exemplary embodiment not having a decolorizing function, are not particularly limited. Toner containing colorants, well-known non-decolorizable toner particles of the related art containing a binder resin and the like, and additives added to a toner particle surface, if necessary, can be used. In addition, in a case of a two-component developer, the toner and a carrier are mixed. As the colorant, carbon black, a well-known pigment such as a condensed polycyclic pigment, an azo pigment, a phthalocyanine pigment, an inorganic pigment, a dye, or the like can be used, for example. As the binder resin, a polyester resin, a styrene-acrylic resin, or the like can be used, for example. In addition, wax as a fixing auxiliary component or a charge control agent (CCA) can be added to the toner particles. Among the non-decolorizable toners, it is preferable to use the non-decolorizable toner having a fixation temperature which is nearly equal to that of the decolorizable toner, in terms of the fixation temperature and the decolorizing temperature of the decolorizable toner accommodated in the developer 14*e*.

In addition, the decolorizable blue toner, which is the recording material of the exemplary embodiment having a decolorizing function, can be decolorized when a temperature thereof reaches a specific temperature (decolorizing temperature) or higher, and can cause a reversible colorizing and decolorizing reaction with which the decolorizable blue toner regains the color at a specific temperature (recoloring temperature) or lower. Such decolorizable toner at least contains a decolorizable coloring material and a binder resin. In addition, the wax or the charge control agent may be contained, if necessary. Further, an additive may be combined separately from the toner particles. As the binder resin, a polyester resin having a low glass transition temperature is used, from a viewpoint of a low temperature fixation.

The decolorizable coloring material is not particularly limited as long as it is a colorable compound which has a function of decolorizing by being heated to a temperature and recoloring by being cooled. A leuco dye is used as a generally-well-known coloring material. By appropriately combining the coloring material with a developer or a decolorizing agent, or a decolorizing temperature adjusting agent and the function of decolorizing at a temperature equal to or higher than a given temperature and recoloring at a temperature equal to or lower than a given temperature is obtained. The coloring compound such as the leuco dye, the developer, and the decolorizing agent will be described hereinafter.

The leuco dye is an electron-donating compound which can perform coloring through the developer. Examples thereof include diphenylmethane phthalides, phenyl indolyl phthalides, indolyl phthalides, diphenylmethane azaphthalides, phenyl indolyl azaphthalides, fluorans, styryl quinolines, diaza rhodamine lactones, and the like.

Specific examples thereof include 3,3-bis(p-dimethyl aminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N -methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methyl indole-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, 3-(2-ethoxy-4-diethylaminophenyl)-3-(1-pentyl-2-methyl indol-3-yl)-4,5,6,7-tetrachlorophthalide, and the like. In addition, examples thereof include pyridine, quinazoline, and bisquinazoline compounds. These examples may be used by mixing two or more kinds.

The developer is an electron-accepting compound which applies a proton to the leuco dye. Examples thereof include phenols, phenol metal salts, carboxylic acid metal salts, aromatic carboxylic acids, aliphatic carboxylic acids having 2 to 5 carbon atoms, benzophenones, sulfonic acid, sulfonic acid salts, phosphoric acids, phosphoric acid metal salts, acid phosphate ester, acidic phosphoric ester metal salts, phosphorous acids, phosphorous acid metal salts, monophenols, polyphenols, 1,2,3-triazole, and derivatives thereof, and substituents thereof include substituents including an alkyl group, an aryl group, an acyl group, an alkoxycarbonyl group, a carboxyl group, and an ester or amide group thereof, or a halogen group, bis-type and tris-type phenol, phenol-aldehyde condensed resin, and metal salts thereof. These examples may be used by mixing two or more kinds.

Specific examples thereof include phenol, o-cresol, t-butylcatechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, p-hydroxy benzyl benzoate, dihydroxybenzoic acid or esters thereof, for example, 2,3-dihydroxybenzoic acid, 3,5-dihydroxybenzoic acid methyl, resorcinol, gallic acid, dodecyl gallate, ethyl gallate, butyl gallate, propyl gallate, 2,2-bis(4-hydroxyphenyl)propane, 4,4-dihydroxy diphenyl sulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl)n-octane, 1,1-bis(4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)n-heptane, 2,2-bis(4-hydroxyphenyl)n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-triol benzene, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidene tris-phenol, 4,4'-(1-methylethylidene)bisphenol, methylene tris-p-cresol, and the like.

In a three-component system of the colorable compound, the developer, and the decolorizing agent, the well-known decolorizing agent can be used as long as it can disturb the coloring reaction caused by the colorable compound and the developer by heat for colorless operation. Examples thereof include alcohols, esters, ketones, ethers, and acid amides. These examples may be used by mixing two or more kinds.

Figure 2:
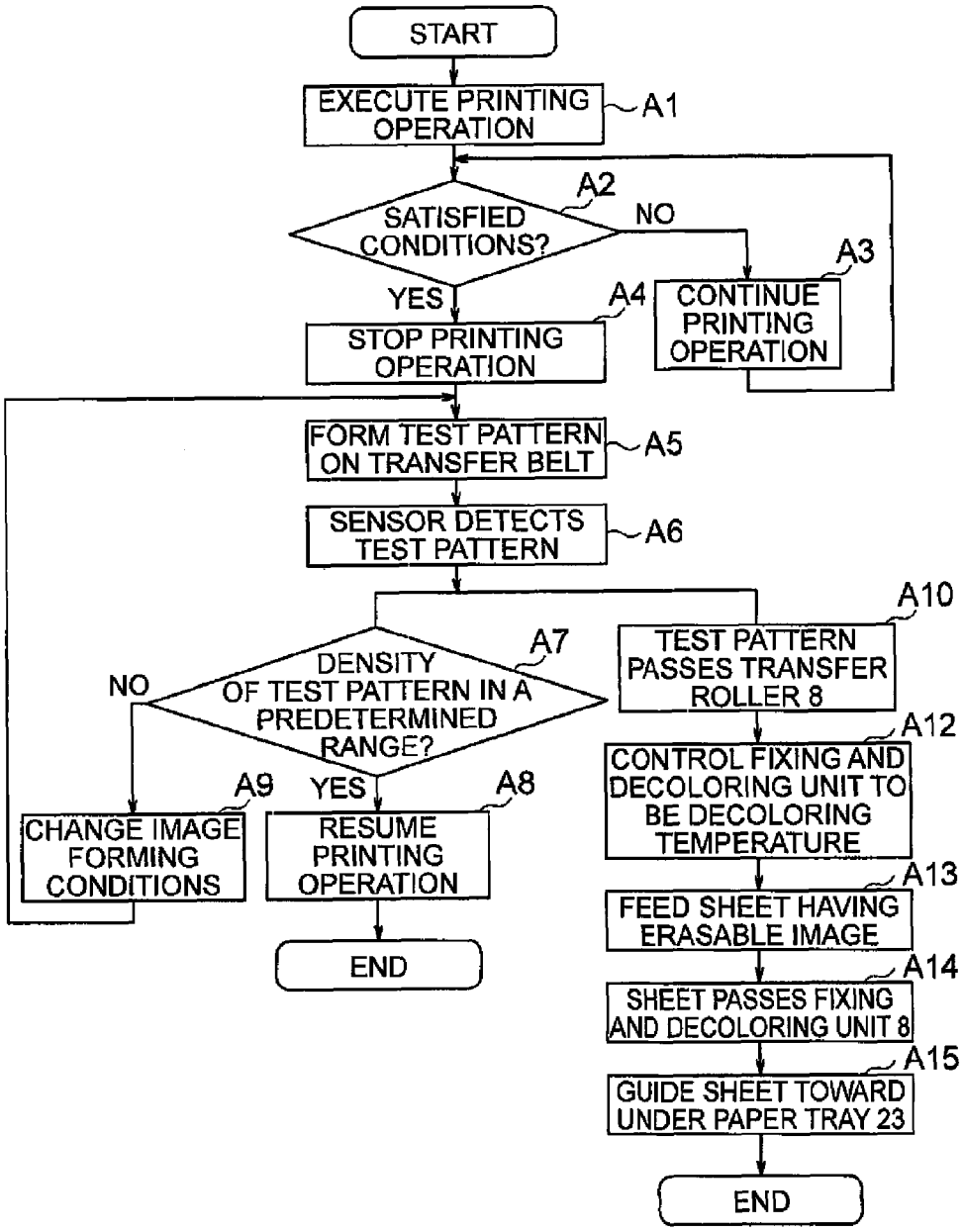
FIG. 2 is a flowchart showing an operation of the image forming apparatus according to the first embodiment.

Next, one example of the operation of the image forming apparatus according to the first embodiment will be described with reference to FIG. 2. FIG. 2 is a flowchart showing an operation of the image forming apparatus when the interruption operation includes the image quality maintaining operation. FIG. 2 describes the case where the interruption operation is the image quality maintaining operation. However, as described above, the interruption operation is not limited to the image quality maintaining operation, and positioning operation, toner forcible supply operation, development of printing data, and the like may be included and can be executed by the same procedure.

First, the controller 10 executes a printing operation with the non-decolorizable toner which is the non-decolorizable recording material (A1). It is determined whether or not conditions for performing the image quality maintaining operation during the printing operation are satisfied (A2). Herein, the conditions for performing the image quality maintaining operation can include, for example, the predetermined number of passing sheets (for example, for every 1000 sheets) or rapid environmental change (for example, the temperature fluctuates by 5° C. or more or the humidity fluctuates by 20% or more from the previous detection time).

When the conditions for performing the image quality maintaining operation are not satisfied, the printing operation is continued (A3). When the conditions for performing the image quality maintaining operation are satisfied, the printing operation is stopped and the image quality maintaining operation is started (A4). As the image quality maintaining operation, first, an image quality test pattern (hereinafter, referred to as a "test pattern") is formed on the transfer belt 5 (A5). Next, the density of the test pattern is determined by the controller based on the test pattern detected by a sensor 25 provided between the image forming unit 6*e* and the secondary transfer roller 8 (A6). Then, it is determined whether or not the density of the test pattern falls in a range of a predetermined density (A7). When the density of the test pattern falls in the range of the predetermined density, the printing operation is resumed (A8).

On the other hand, when the density of the test pattern is outside the range of the predetermined density, imaging conditions such as developing bias voltage or laser power are changed and controlled (A9). After the imaging conditions is changed, a new test pattern is formed on the transfer belt 5 and the density thereof is determined by the controller 10 based on the new test pattern detected by the sensor 25 (A5, A6). In this case, after the test pattern passes the secondary transfer roller 8, or after the test pattern on the transfer belt 5 passes the secondary transfer roller 8 (A10), the decolorizing operation is started (A11), and the temperature of the fixing and erasing unit 9 is controlled to be the decolorizing temperature or to be a temperature equal to or higher than the decolorizing temperature (A12). Before a test pattern formed in new imaging conditions reaches the secondary transfer roller 8, a sheet having an erasable image is fed from the erasable image sheet accommodation unit 4*b* to the fixing and erasing unit 9 (A13), the temperature of which is controlled to be the decolorizing temperature. Then, the image is erased by the fixing and erasing unit 9 (A14). The sheet subjected to the erasing operation is guided to the paper discharge unit 23 by the flapper 24 (A15).

(Second Embodiment)

Figure 3:
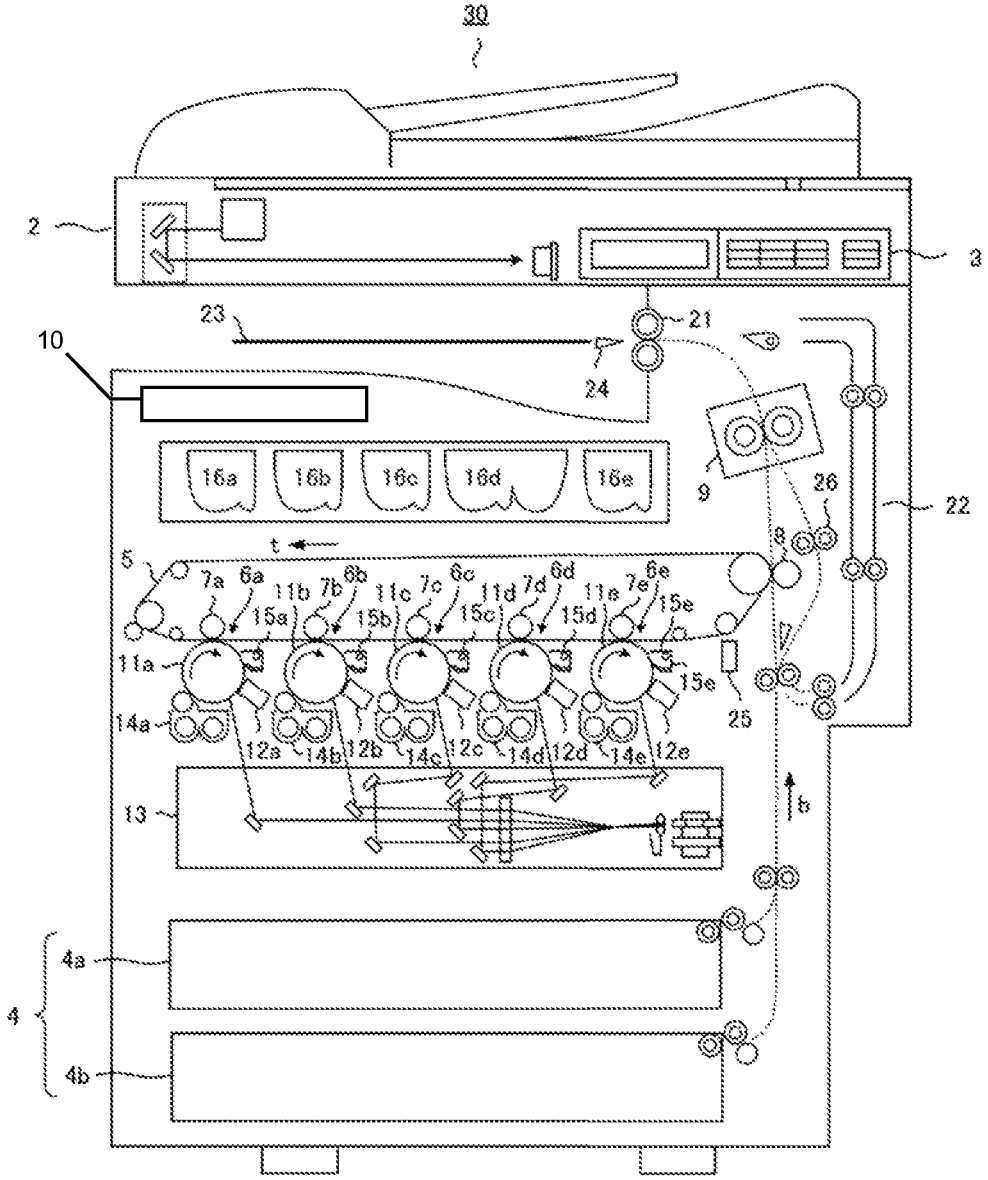
FIG. 3 is a schematic configuration diagram of an image forming apparatus according to a second embodiment.

FIG. 3 shows an image forming apparatus according to a second embodiment. In the second embodiment, a transportation path to convey a sheet from the paper feeding unit 4 to the fixing and erasing unit 9 without passing through the secondary transfer roller 8, but through the transportation roller 26, is provided in addition to a transportation path to convey a sheet from the paper feeding unit 4 to the fixing and erasing unit 9 through the secondary transfer roller 8. With these transportation paths, the decolorizing operation during the interruption operation can be performed for a longer period of time, compared to the image forming apparatus according to the first embodiment.

Figure 4:
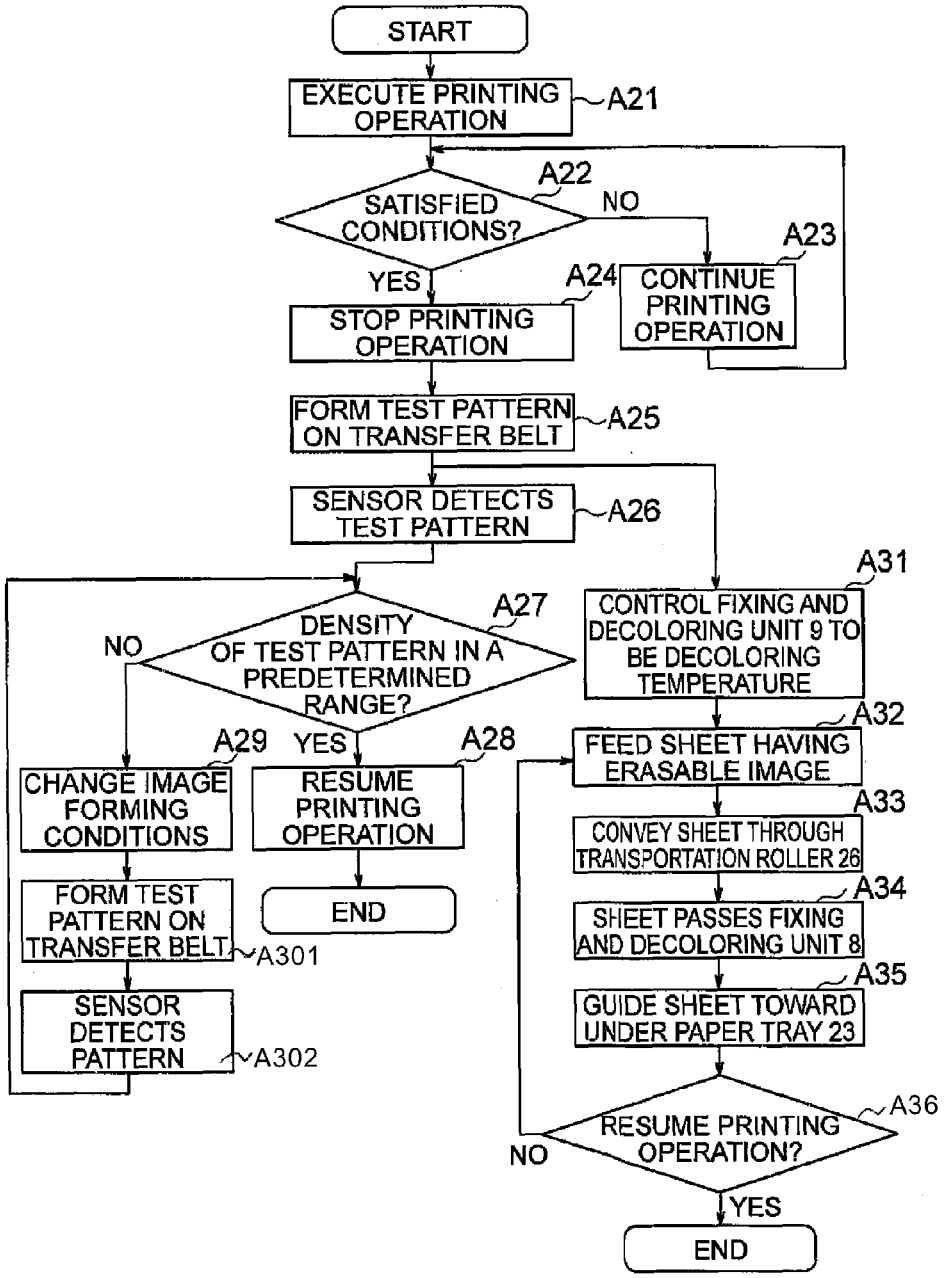
FIG. 4 is a flowchart showing an operation of the image forming apparatus according to the second embodiment.

One example of the operation of the image forming apparatus according to the second embodiment will be described with reference to FIG. 4. FIG. 4 is a flowchart showing an operation of the image forming apparatus when the interruption operation is the image quality maintaining operation. FIG. 4 describes an example in which the interruption operation includes the image quality maintaining operation. However, in the same manner as the first embodiment, the interruption operation is not limited to the image quality maintaining operation, and the positioning operation, the toner forcible supply operation, the development of printing data, and the like can be includes and executed by the same procedure.

First, the controller 10 executes a printing operation with the non-decolorizable toner which is the non-decolorizable recording material (A21). It is determined whether or not the conditions for performing the image quality maintaining operation during the printing operation are satisfied (A22). When the conditions for performing the image quality maintaining operation are not satisfied, the printing operation is continued (A23). When the conditions for performing the image quality maintaining operation are satisfied, the printing operation is stopped and the image quality maintaining operation is started (A24). As the image quality maintaining operation, first, the test pattern is formed on the transfer belt 5 (A25). The density of the test pattern is determined by the controller based on the test pattern detected by the sensor provided between the image forming unit 6*e* and the secondary transfer roller 8 (A26). Then, it is determined whether or not the density of the test pattern falls in a range of a predetermined density (A27). When the density of the test pattern falls in the range of the predetermined density, the printing operation is resumed (A28). When the density of the test pattern is outside the range of the predetermined density, imaging conditions such as developing bias voltage or laser power are changed and controlled (A29), and the above-described operations are performed until the density of the test pattern falls in the predetermined density range.

Meanwhile, after the image quality maintaining operation is performed and the test pattern is formed on the transfer belt 5, the decolorizing operation is started (A30). The temperature of the fixing and erasing unit 9 is controlled to be the decolorizing temperature or to be a temperature equal to or higher than the decolorizing temperature (A31). A sheet having an erasable image is fed from the erasable image sheet accommodation unit 4*b* to the transportation path (A32). After that, the decolorizable image sheet is guided to the transportation roller 26 by a flapper 27, which is provided upstream with respect to the secondary transfer roller 8 in a sheet transporting direction, and is fed to the fixing and erasing unit 9, the temperature of which is controlled to be the decolorizing temperature, through the transportation roller 26 (A33). Then, the fixing and erasing unit 9 erases the image on the sheet (A34). The decolorizable image sheet subjected to the erasing operation is guided to the paper discharge unit (paper tray) 23 by the flapper 24 (A35). The decolorizing operation is performed until the interruption operation is finished.

In the exemplary embodiments, the toner is described as an example of the decolorizable recording material and the non-decolorizable recording material. In addition, liquid-type ink, gel-type ink, ink ribbon, and the like can be used according to the embodiment of the image forming apparatus.

According to the image forming apparatus of the exemplary embodiments, the decolorizing operation on the sheet having the erasable image can be efficiently performed during the interruption operation. As image forming apparatus can effectively produces the reusable sheets, it may prompt the user to use the reusable sheets. This further leads to reduction of carbon dioxide emissions and preservation of forest resources.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions and the accompanying claims and their equivalents are intended to cover such forms or modifications as would fall within the scope and spirit of the inventions.

What is claimed is:

1. An image forming apparatus comprising:

an image forming unit configured to form images that are to be transferred to first sheets;

a fixing and erasing unit configured to fix the images onto the first sheets and erase images formed with a decolorizable material on second sheets; and a controller configured to:

interrupt the image forming unit to stop formation of images that are to be transferred to the first sheets, and control the fixing and erasing unit to carry out an erasing operation on the second sheets while the image forming unit is interrupted.

2. The image forming apparatus according to claim 1, further comprising:

a transfer unit on which the images that are to be transferred to the first sheets are formed; and a sensor configured to detect images formed on the transfer unit, wherein the controller is further configured to:

control the image forming unit to form a test image;

determine a density of the test image formed on the transfer unit based on the detection result of the sensor, determine whether or not the determined density is within a predetermined range, and control the image forming unit to resume the forming of the images that are to be transferred to the first sheets, when the determined density is within the predetermined range.

3. The image forming apparatus according to claim 2, wherein the images formed on the transfer unit are transferred to the first sheets at a transfer region of the transfer unit, the second sheets are conveyed to the fixing and erasing unit through the transfer region, and the controller is further configured to cause one of the second sheets to be conveyed through the transfer region after the test image formed on the transfer unit has passed the transfer region.

4. The image forming apparatus according to claim 2, wherein the images on the transfer unit are transferred to the first sheets at a transfer region of the transfer unit, and the second sheets are conveyed to the fixing and erasing unit without passing through the transfer region.

5. The image forming apparatus according to claim 2, wherein the images that are to be transferred to the first sheets and the test image are formed with a non-decolorizable material.

6. The image forming apparatus according to claim 2, wherein the controller is further configured to:

change a condition of an image formation by the image forming unit, when the determined density of the test image is out of the predetermined range, control the image forming unit to form a new test image on the transfer unit using the changed condition of the image formation, determine a density of the new test image formed on the transfer unit based on the detection result of the sensor, determine whether or not the determined density of the new test image is within the predetermined range, and control the image forming unit to resume the formation of the images, when the determined density of the new test image is within the predetermined range.

7. The image forming apparatus according to claim 1, further comprising:

a guide unit configured to guide a sheet passing through the fixing and erasing unit in a first direction or a second direction, wherein the controller is configured to control the guide unit to guide the first sheets in the first direction and the second sheets in the second direction.

8. The image forming apparatus according to claim 1, wherein the controller is further configured to determine the number of sheets that have been fixed by the fixing and erasing unit, and the interruption of the image forming unit is carried out when the determined number of sheets reaches a predetermined number.

9. A method for operating an image forming apparatus including an image forming unit configured to form images that are to be transferred to first sheets, and a fixing and erasing unit configured to fix the images onto the first sheets and erase images formed with a decolorizable material on second sheets, the method comprising:

interrupting the image forming unit to stop formation of images that are to be transferred to the first sheets; and controlling the fixing and erasing unit to carry out an erasing operation on the second sheets while the image forming unit is interrupted.

10. The method according to claim 9, wherein the image forming apparatus further includes a transfer unit on which the images that are to be transferred to the first sheets are formed, and a sensor configured to detect images formed on the transfer unit, the method further comprising:

controlling the image forming unit to form a test image;

determining a density of the test image formed on the transfer unit based on the detection result of the sensor;

determining whether or not the determined density is within a predetermined range; and controlling the image forming unit to resume the formation of the images that are to be transferred to the first sheets, when the determined density is within the predetermined range.

11. The method according to claim 10, wherein the images on the transfer unit are transferred to the first sheets at a transfer region of the transfer unit, and one of the second sheets is conveyed to the fixing and erasing unit through the transfer region after the test image formed on the transfer unit has passed the transfer region.

12. The method according to claim 10, wherein the images on the transfer unit are transferred to the first sheets at a transfer region of the transfer unit, and the second sheets are conveyed to the fixing and erasing unit without passing through the transfer region.

13. The method according to claim 10, wherein the images that are to be transferred to the first sheets and the test image are formed with a non-decolorizable material.

14. The method according to claim 10, further comprising:

changing a condition of an image formation by the image forming unit, when the determined density of the test image is out of the predetermined range;

controlling the image forming unit to form a new test image on the transfer unit using the changed condition of the image formation;

determining a density of the new test image on the transfer unit based on the detection result of the sensor;

determining whether or not the determined density of the new test image is within the predetermined range; and controlling the image forming unit to resume the formation of the images, when the determined density of the new test image is within the predetermined range.

15. The method according to claim 10, further comprising:

guiding the first sheets passing through the fixing and erasing unit in a first direction; and guiding the second sheets passing through the fixing and erasing unit in a second direction.

16. The method according to claim 9, further comprising:

determining the number of sheets that have been fixed by the fixing and erasing unit; and the interruption of the image forming unit is carried out when the determined number of sheets reaches a predetermined number.

17. An image forming apparatus comprising:

an image forming unit configured to form images that are to be transferred to first sheets;

a fixing and erasing unit configured to fix the images onto the first sheets and erase images formed with a decolorizable material on second sheets; and a controller configured to:

determine whether or not the image forming unit stops forming images for a predetermined time period, and control the fixing and erasing unit to carry out an erasing operation on the second sheets during the predetermined time period.

18. The image forming apparatus according to claim 17, further comprising:

a transfer unit on which the images that are to be transferred to the first sheets are formed; and a sensor configured to detect images formed on the transfer unit, wherein the controller is configured to:

control the image forming unit to form a test image;

determine a density of the test image formed on the transfer unit based on the detection result of the sensor, determine whether or not the determined density is within a predetermined range, and control the image forming unit to resume the forming of the images that are to be transferred to the first sheets, when the determined density is within the predetermined range.

19. The image forming apparatus according to claim 17, wherein the image on the transfer unit is transferred to the first sheets at a transfer region of the transfer unit, the second sheets are conveyed to the fixing and erasing unit through the transfer region, and the controller is further configured to cause the second sheets to be conveyed through the transfer region after the test image formed on the transfer unit has passed the transfer region.

20. The image forming apparatus according to claim 17, wherein the images on the transfer unit are transferred to the first sheets at a transfer region of the transfer unit, and the second sheets are conveyed to the fixing and erasing unit without passing through the transfer region.

* * * * *